US010826187B1

(12) United States Patent
Godard et al.

(10) Patent No.: US 10,826,187 B1
(45) Date of Patent: Nov. 3, 2020

(54) RADIATING INTERRUPTED BOUNDARY SLOT ANTENNA

(71) Applicant: Ball Aerospace & Technologies Corp., Boulder, CO (US)

(72) Inventors: Joel J. Godard, Denver, CO (US); Jeffrey A. Godard, Littleton, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 37 days.

(21) Appl. No.: 16/224,120

(22) Filed: Dec. 18, 2018

Related U.S. Application Data

(63) Continuation-in-part of application No. 15/979,200, filed on May 14, 2018.

(60) Provisional application No. 62/505,241, filed on May 12, 2017.

(51) Int. Cl.

| | |
|---|---|
| ***H01Q 15/02*** | (2006.01) |
| ***H01Q 13/18*** | (2006.01) |
| ***H01Q 5/50*** | (2015.01) |
| ***H01Q 5/314*** | (2015.01) |

(52) U.S. Cl.
CPC ..... *H01Q 13/18* (2013.01); *H01Q 5/314* (2015.01); *H01Q 5/50* (2015.01)

(58) Field of Classification Search
CPC ..... H01Q 15/008; H01Q 15/00; H01Q 15/05; H01Q 5/31; H01Q 5/314; H01Q 5/50; H01Q 5/42; H01Q 9/40; H01Q 9/42; H01Q 1/38; H01Q 13/10; H01Q 13/18; H01Q 19/00
See application file for complete search history.

(56) References Cited

U.S. PATENT DOCUMENTS

| | | | | |
|---|---|---|---|---|
| 4,054,874 | A * | 10/1977 | Oltman, Jr. | H01Q 9/0457 343/700 MS |
| 5,160,936 | A * | 11/1992 | Braun | H01Q 13/18 343/700 MS |
| 5,394,163 | A * | 2/1995 | Bullen | H01Q 1/281 343/700 MS |
| 5,892,485 | A * | 4/1999 | Glabe | H01Q 19/108 343/756 |
| 6,075,485 | A * | 6/2000 | Lilly | H01Q 1/38 343/700 MS |
| 7,639,206 | B2 * | 12/2009 | Behdad | H01Q 1/286 333/202 |
| 8,736,502 | B1 | 5/2014 | Langfield et al. | |
| 9,263,791 | B2 * | 2/2016 | Anderson | H01Q 19/065 |
| 9,373,895 | B1 | 6/2016 | Langfield et al. | |
| 2003/0020655 | A1 * | 1/2003 | McKinzie, III | H01Q 1/38 343/700 MS |
| 2011/0273351 | A1 | 11/2011 | Johnson | |

* cited by examiner

*Primary Examiner* — Tho G Phan
(74) *Attorney, Agent, or Firm* — Sheridan Ross P.C.

(57) ABSTRACT

Cavity backed slot antenna systems and methods are provided. The systems include a frequency selective surface, a housing containing a cavity, and a feed structure between at least portions of the frequency selective surface and the cavity. The frequency selective surface can be embedded in a non-conductive slot in a first ground plane. The cavity can contain a space filler. Embodiments of the present disclosure provide an antenna with a relatively wide bandwidth and a relatively small antenna element.

20 Claims, 6 Drawing Sheets

RADIATING INTERRUPTED BOUNDARY SLOT ANTENNA

CROSS-REFERENCE TO RELATED APPLICATIONS

This application is a continuation in part of U.S. patent application Ser. No. 15/979,200, filed May 14, 2018, which claims the benefit of U.S. Provisional Patent Application Ser. No. 62/505,241, filed May 12, 2017, the entire disclosures of which are hereby incorporated herein by reference.

FIELD

The present disclosure provides systems and methods to broadband a cavity backed slot antenna.

BACKGROUND

The installation of antennas and antenna arrays in volume constrained platforms is a consistent and challenging problem for both commercial and military organizations. Applications requiring the use of conformal antennas (confined to the surface of an associated platform) are particularly demanding. Many attempts at solving this problem have been made with some success principally in the area of single antenna apertures. There has been little improvement, however, in the development of antenna elements that can be used both singularly and in arrays for these difficult situations.

In addition to needing to comply with physical space limitations, antennas are increasingly required to provide support over a wide range of frequencies. However, providing such broadband performance is challenging, particularly where space is limited. Moreover, in at least some antenna configurations there is a trade between the size of the antenna and the available bandwidth.

A cavity-backed slot antenna can provide an antenna having a size that is relatively small as compared to alternate designs, such as dipole antennas. Moreover, cavity-backed slot antennas can be mounted on or can form the surface of an associated structure, such as the surface of an aircraft or other vehicle. However, the bandwidth ratio of cavity-backed slot antennas is usually limited to no more than 3:1. In addition, conventional techniques for increasing the bandwidth of a cavity-backed slot antenna often require an increase in the volume of the antenna cavity.

SUMMARY

Embodiments of the present disclosure provide cavity backed slot antennas with broadband characteristics, and methods to broadband cavity backed slot antennas. Embodiments of the present disclosure can provide an antenna element design that is small enough to be used as an individual radiator or as one of many radiators in an array for conformal, volume constrained applications. The present disclosure enables a reduction in element size, allowing for elements to be placed at less than half-wavelength spacing at the highest frequency of operation while maintaining broad bandwidth. The broad bandwidth allows the use of fewer antennas to cover the full frequency range resulting in less volume use of the platform. The small element size for half-wavelength spacing allows the use of the element in an array without the unintended result of radiation in grating lobes (high gain levels in unintended directions due to large spacing between array apertures).

Typical cavity backed slot antennas have a bandwidth of ~8-10% BW and typical methods of increasing this bandwidth may lead to a 3:1 bandwidth. Embodiments of the present disclosure allow bandwidths of 9:1 or greater while significantly reducing the size of the antenna element. For example, while a conventional cavity backed slot antenna has a cavity with a depth of a quarter λ, a cavity backed slot antenna element in accordance with embodiments of the present disclosure may have dimensions of, for example, $0.169\lambda \times 0.051\lambda \times 0.034\lambda$ at the lowest frequency.

An antenna in accordance with embodiments of the present disclosure can feature a distributed resistor, inductor, and capacitor (RLC) network that is placed directly into the antenna aperture or slot in the form of an integrated frequency selective surface (FSS). Moreover, the manner in which these FSS components have been integrated directly into the aperture allows the radiating portion of the aperture to scale over frequency, maintaining the shape of the radiation pattern over the full operating band, while avoiding distortions in the shape of the radiation pattern that can be caused by over-moding in a conventional configuration. Further improvements to the bandwidth of the antenna can be made with the application of frequency dependent magnetic materials over the aperture. Embodiments of the present disclosure provide an antenna element that can be used as a single antenna or in an array.

An antenna in accordance with further embodiments of the present disclosure can include a feed structure or element that extends across the slot. In accordance with at least some embodiments of the present disclosure, the feed element comprises a fan shaped structure. The fan shaped feed can include a first portion defined by sides that extend from a feed point at or adjacent a first side of the slot to a line at or adjacent a second side of the slot. Accordingly, all or a majority of the first portion of the feed overlies the slot. The fan shaped feed can additionally include a second portion defined at least in part by a curved edge that extends between the sides such that all or a majority of the second portion of the feed overlies a portion of a ground plane in which the slot is formed.

Additional features and advantages of embodiments of the disclosed systems and methods will become more readily apparent from the following description, particularly when taken together with the accompanying drawings.

DETAILED DESCRIPTION

Figure 1A:
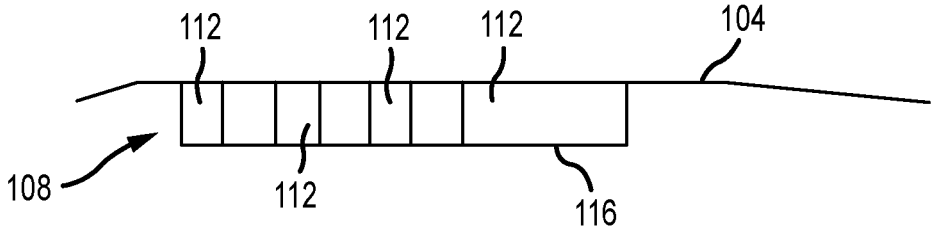
FIG. 1A depicts an antenna system incorporating an array of antenna elements in accordance with embodiments of the present disclosure in a cross section view.
Figure 1B:
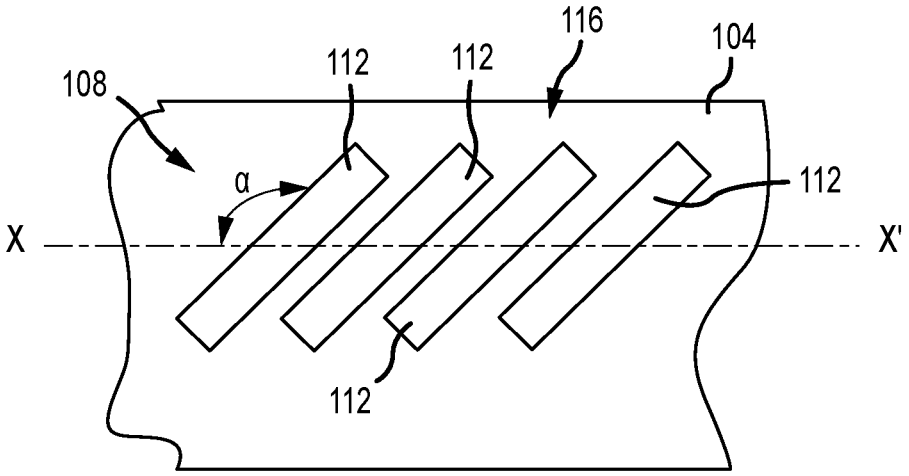
FIG. 1B depicts the antenna system of FIG. 1A in a plan view.

Embodiments of the present disclosure are generally directed to an antenna that can be conformally mounted, and that provides a relatively high bandwidth. FIG. 1A illustrates a partial cross section of an area of a vehicle or platform 104 that incorporates an antenna system 108 having a number of cavity backed slot antenna elements 112 in accordance with embodiments of the present disclosure disposed in an array 116. FIG. 1B depicts the antenna system 108 of FIG. 1A in a plan view. As shown in FIG. 1A, the antenna system 108 can be conformally mounted, such that a portion of the vehicle 104 surface is formed by, or is immediately adjacent, a surface of the antenna system 108. The cavity backed slot antenna elements 112 can be configured each have the same or different operating bandwidths. Although the example antenna system 108 illustrated in FIGS. 1A-B is configured as an array 116 having a plurality of closely spaced cavity backed slot antenna elements 112, embodiments of the present invention are not so limited. For example, an antenna system 108 in accordance with embodiments of the present disclosure can include a single cavity backed slot antenna element 112. As yet another example, an antenna system 108 in accordance with embodiments of the present disclosure can include an array 116 in which the included cavity backed slot antenna elements 112 are located directly adjacent one another. For example, adjacent cavity backed slot antenna elements 112 can be separated by a distance of less than half the wavelength of the highest frequency of operation of either of the adjacent cavity backed slot antenna elements 112. Moreover, an antenna system 108 in accordance with embodiments of the present disclosure can include an array in which the included cavity backed slot antenna elements 112 are disposed at the same or various angles, orientations, or positions relative to a reference line. For example, as shown in FIG. 1B, the individual cavity backed slot antennas 112 can be arranged such that they are each intersected by a line X-X', and moreover can be at an angle greater than 0 and less than 90 degrees relative to the reference line X-X'.

Figure 2:
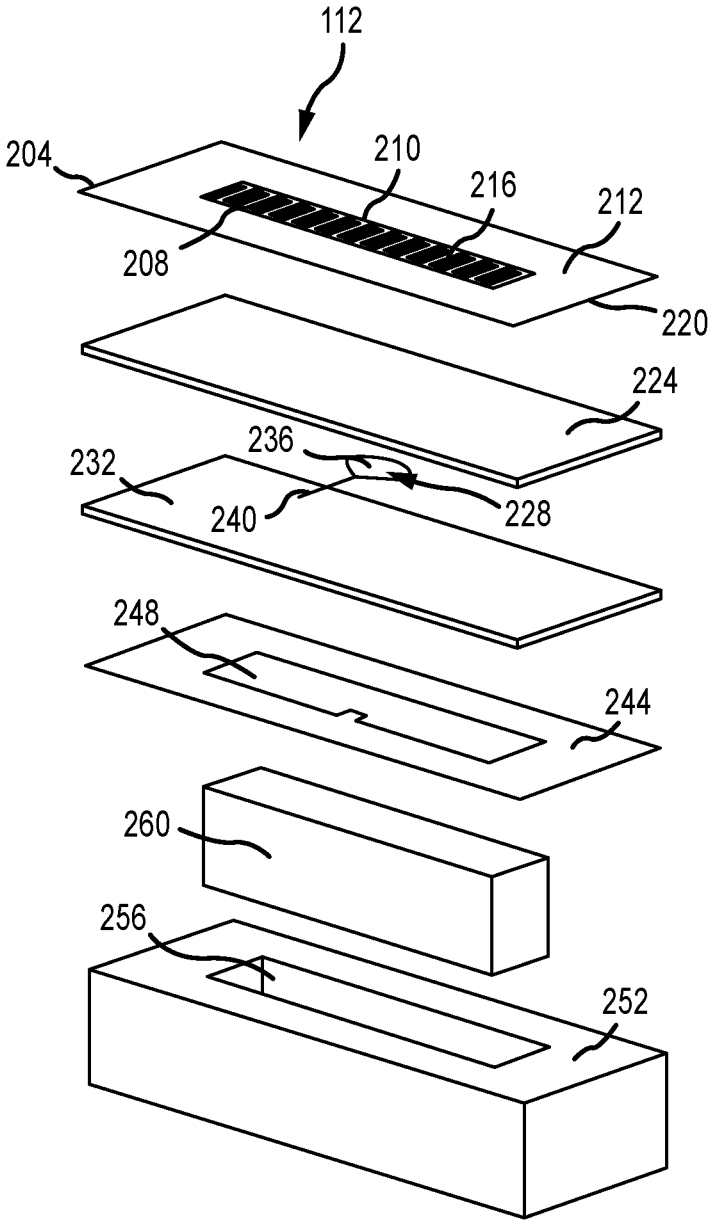
FIG. 2 is an exploded perspective view of an antenna element in accordance with embodiments of the present disclosure.

FIG. 2 illustrates a cavity backed slot antenna element 112, and in particular depicts components that can be included in a broadband, cavity backed slot antenna element 112 in accordance with embodiments of the present disclosure in an exploded perspective view. The cavity backed slot antenna element 112 includes a first ground plane 204 having a planar conductive surface, with a non-conductive slot 208 formed therein. As can be appreciated by one of skill in the art after consideration of the present disclosure, the non-conductive slot 208 is defined by an aperture 210 formed in the first ground plane 204. In accordance with an exemplary embodiment of the present disclosure, the first ground plane 204 is formed from a sheet of metal, such as aluminum or copper. As can be appreciated by one of skill in the art after consideration of the present disclosure, a first surface 212 of the first ground plane 204 may form an outside surface of the antenna element 112. Moreover, where the antenna system 108 including the cavity backed slot antenna element 112 is mounted to a vehicle or platform 104, the first surface 212 of the first ground plane can, for example, comprise a portion of a surface of that vehicle or platform 104, or can be located directly underneath a surface of the vehicle or platform 104.

An embedded frequency selective surface (FSS) 216 is contained within or adjacent the slot 208. For example, the FSS 216 can coincide with a plane that also coincides with or that is parallel to a plane of the ground plane 204. The FSS 216 of a cavity backed slot antenna element 112 in accordance with embodiments of the present disclosure provides capacitive, inductive, and/or resistive loading of the cavity 256, increasing the effective depth of the cavity 256. For example, the FSS 216 may comprise one or more components that extend from one or more edges of the slot 208, in a plane corresponding to the plane of the first ground plane 204. Moreover, the FSS 216 may comprise electrically conductive lines, such as metallic lines, that extend from one or more edges of the slot 208. In certain embodiments the FSS 216 may include conductive, resistive, inductive, and/or capacitive components, thereby forming an RLC network. A second surface 220 of the first ground plane 204, and features or components of the FSS 216, may be supported by or connected to a first dielectric layer 224. The first dielectric layer 224 can span the slot 208. In addition, the first dielectric layer 224 can extend across all or portions of the second surface 220 of the first ground plane 204. The first dielectric layer 224 may comprise, for example, a thin dielectric sheet comprising ceramic and Teflon based circuit board materials, or other dielectric materials.

The cavity backed slot antenna element 112 can also include a conductive feed structure or element 228. The feed element 228 can be located between the first dielectric layer 224 and a second dielectric layer 232. In accordance with at least some embodiments of the present disclosure, the feed element 228 includes a flared feed section 236 and a strip line feed 240. The flared feed section 236 as shown is shaped as a fan, but may take on many other shapes in order to tailor the bandwidth and gain to specific applications. The feed element 228 can therefore be configured so that it contributes to the broad bandwidth of the cavity backed slot antenna element 112. In accordance with alternate embodiments of the present disclosure, the feed element 228 comprises another configuration, such as a monopole. The strip line feed 240 portion of the feed element 228 can in turn be connected to transmit/receive components. The second dielectric layer 232 may be connected to the first dielectric layer 224, at least in portions surrounding the feed element, using adhesive or fusion bonding. Alternatively, the second dielectric layer 232 may be formed from the same piece of material as is the first dielectric layer 224, for example as a single piece of folded material encapsulating the flared feed 236 and at least portions of the strip line feed 240.

In at least some embodiments, the cavity backed slot antenna element 112 can additionally include a second ground plane 244. If provided, the second ground plane 244 is separated from the feed structure 228 by the second layer of dielectric material 232. This second ground plane 244 can include a non-conductive slot or region 248 formed therein. In general, the location of the non-conductive region 248 is in an area corresponding to the cavity 256, described in greater detail elsewhere herein. The second ground plane 244 can be formed from a sheet of conductive material, such as but not limited to aluminum or copper.

The cavity backed slot antenna element 112 additionally includes a housing 252 that is made of an electrically conductive material, and that has a cavity 256 formed therein. The cavity is sized according to the designed bandwidth of the cavity backed slot antenna element 112. However, the unique loading of the cavity by the FSS 216 as described herein allows the cavity to be smaller than it would otherwise be for a given bandwidth. For example, the cavity 256 of a cavity backed slot antenna element 112 in accordance with embodiments of the present disclosure may be sized at $0.169\lambda \times 0.051\lambda \times 0.034\lambda$, where $\lambda$, is the wavelength of the lowest operating frequency. The cavity 256 can contain a space filler 260. Examples of a suitable space filler 260 include, but are not limited to, air, a dielectric, an absorber, a radar absorbing material (RAM), a metamaterial, an artificial magnetic conductor, or other materials. In addition, different space filler 260 materials having different properties can be disposed in different areas of the cavity 256. The space filler 260 may be selected as a material or combination of materials that changes or affects the propagation of electromagnetic waves through the cavity 256 in a way that selectively loads the FSS 216. More particularly, the composition of the space filler 260 can be selected depending upon the desired bandwidth and gain of the cavity 256.

Figure 3:
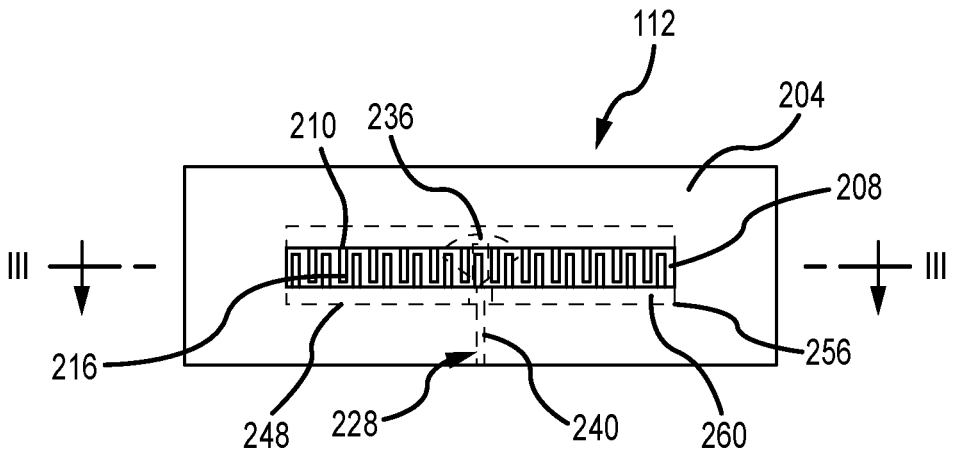
FIG. 3 is a plan view of an antenna element in accordance with embodiments of the present disclosure.

FIG. 3 illustrates the cavity backed slot antenna element 112 in a plan view, and in particular depicts the relative locations of the non-conductive slot 208 formed in the first ground plane 204, the FSS 216 located within or adjacent the non-conductive slot 208, the flared feed section 236 and the strip line feed 240 of the feed structure element 228, and the boundary of the slot 248, which corresponds to or lies within the boundary of the cavity 256, and the space filler 260, in the plan view.

Figure 4:
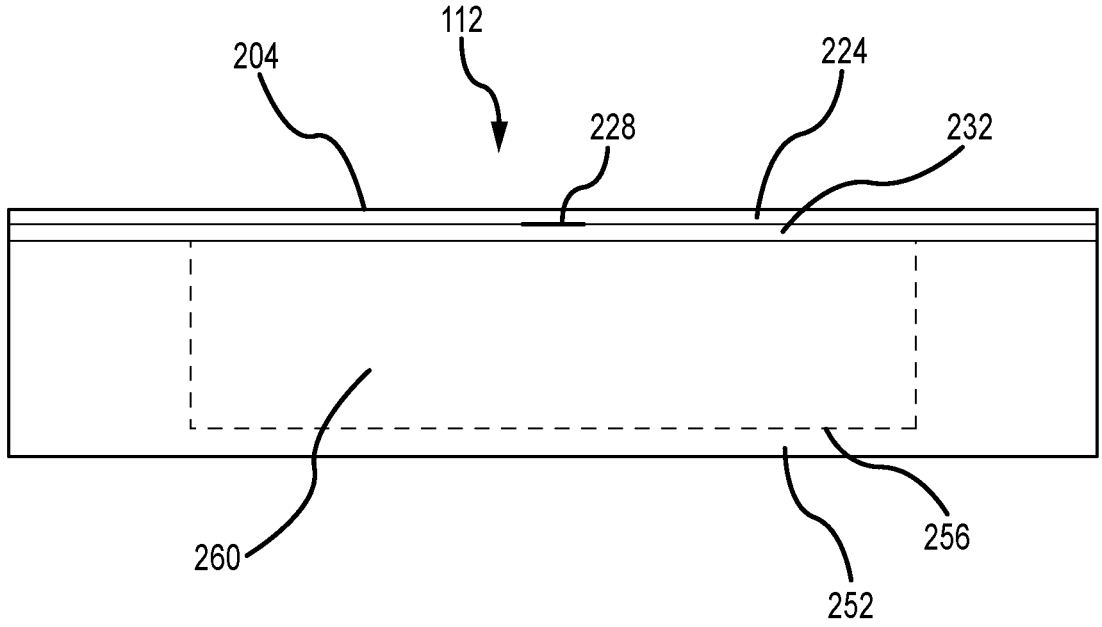
FIG. 4 is an elevation of an antenna element in accordance with embodiments of the present disclosure.

FIG. 4 illustrates the cavity backed slot antenna element 112 in a side elevation, and in particular depicts the relative locations of the first ground plane 204, first dielectric sheet 224, feed structure element 228, second dielectric sheet 232, and housing 252 in an elevation view. Also, the cavity 256 formed within the housing 252 and the space filler 260 are depicted.

Figure 5:
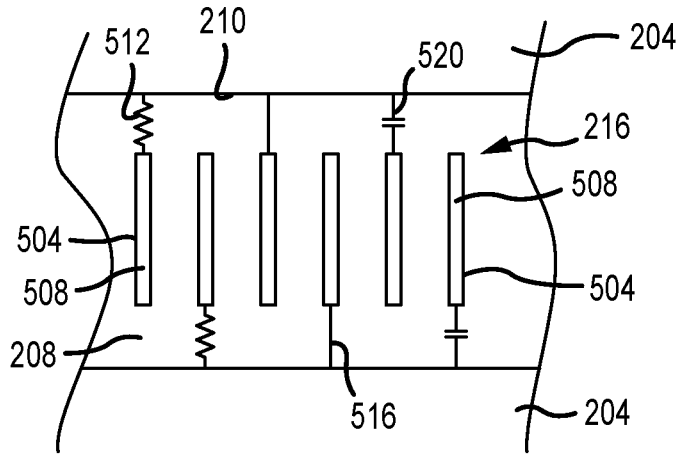
FIG. 5 is a plan view of a portion of a slot and a frequency selective surface of an antenna element in accordance with embodiments of the present disclosure.

In accordance with at least some embodiments of the present disclosure, and as depicted in FIG. 5, the FSS 216 includes a plurality of elements 504 that include electrically conductive areas or lines 508 that are each connected to the first ground plane 204 by at least one of a resistive 512, conductive 516, or capacitive 520 component. The elements 504 can be configured to alternately extend from opposite sides of the slot 208. Moreover, the elements 504 can be arranged in pairs of like types. In accordance with still other embodiments of the present disclosure, elements 504 comprising resistive 512, conductive 516, and/or capacitive 520 components can be arranged in any order.

As can be appreciated by one of skill in the art after consideration of the present disclosure, the values of the components 512, 516, and 520, such as their resistance, inductance, or capacitance, and/or the configuration of the areas or lines 508, can be selected, alone or in combination, to obtain a desired FSS 216 characteristic or set of characteristics. For example, the FSS 216 can be tuned to filter out higher order harmonics that might otherwise be present in the slot 208. The one or more resistive 512, conductive 516, and/or capacitive 520 components can be formed by a printing process. In accordance with at least some embodiments of the present disclosure, the FSS 216 elements 504 may include an array of electrically conductive lines comprising a dipole array. Alternatively or in addition, the FSS 216 may include or be associated with a magnetic material, including by not limited to a frequency dependent magnetic material, that is also located in the slot 208.

Figure 6:
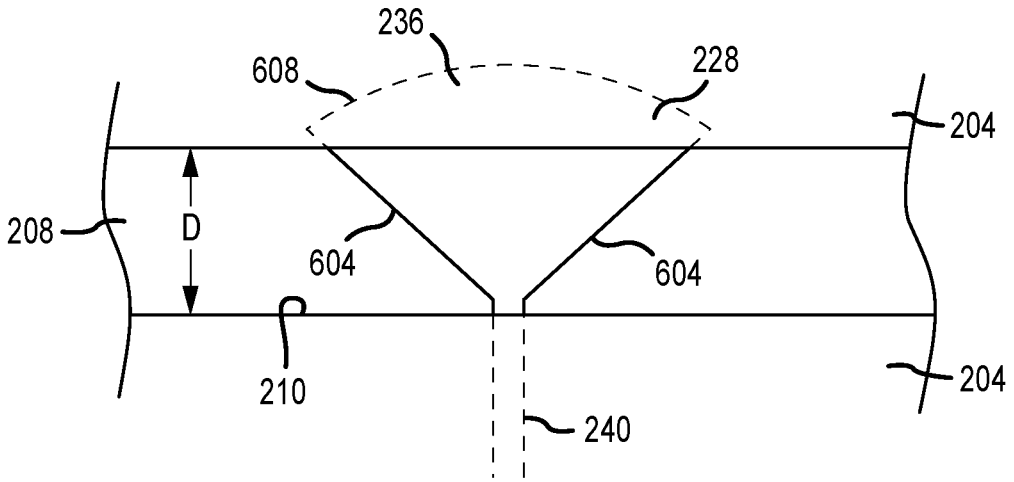
FIG. 6 is a plan view of a portion of a slot and a feed element of an antenna element in accordance with embodiments of the present disclosure.

With reference now to FIG. 6, a portion of a slot 208 in a first ground plane 204 in relation to a feed structure or element 228 in accordance with embodiments of the present disclosure is illustrated in a top plan view. As shown, the feed element 228 generally includes a flared feed section 236 and a strip line feed 240. The strip line feed 240 can extend towards the slot 208, and can intersect with the flared feed section 236 along a line that is near an edge of the aperture 210 defining the slot 208. For example, the intersection between the strip line feed 240 and the flared feed section 236 can be a distance that is less than one tenth of the distance D corresponding to the width of the slot 208. Moreover, the intersection between the strip line feed 240 and the flared feed section 236 can overlay the slot 208. The flared feed section 236 can be configured in the shape of a fan, with straight side portions 604 that extend away from each other with distance from the intersection of the flared feed section 236 and the strip line feed 240, and with a curved or arched portion 608 connecting the ends of the side portions 604 opposite the intersection with the strip line feed 240. In accordance with at least some embodiments of the present disclosure, the portion of the flared feed section 236 that includes the straight side portions 604 can overlay the slot 208. In accordance with further embodiments of the present disclosure, the area of the flared feed section 228 defined by a line extending between the ends of the straight side portions 604 opposite their intersection with the strip line feed 240 and the curved portion 608 overlays a portion of the first ground plane 204 adjacent or near the slot 208.

The feed element 228 generally operates to transfer radio frequency energy between the slot 208 and a transceiver (not shown) in transmit or receive modes of operation. In accordance with embodiments of the present disclosure, the sides 604 of the feed element 228 are angled relative to the adjacent edge of the slot 208 to create a tapered transition that promotes the transition of different, relatively high frequencies (i.e. frequencies with wavelengths that are shorter than the length of the slot) across the slot 208. In accordance with further embodiments of the present disclosure, the portion of the flared feed section 236 that overlays a portion of the first ground plane 204 cooperates with the first ground plane 204 to form a parallel plate capacitor. The capacitance thus introduced by the flared feed section 236 assists in matching the impedance of the antenna element 112 at frequencies with wavelengths that are longer than the slot 208, by cancelling the inductance presented to such frequencies by the slot 208.

Figure 7:
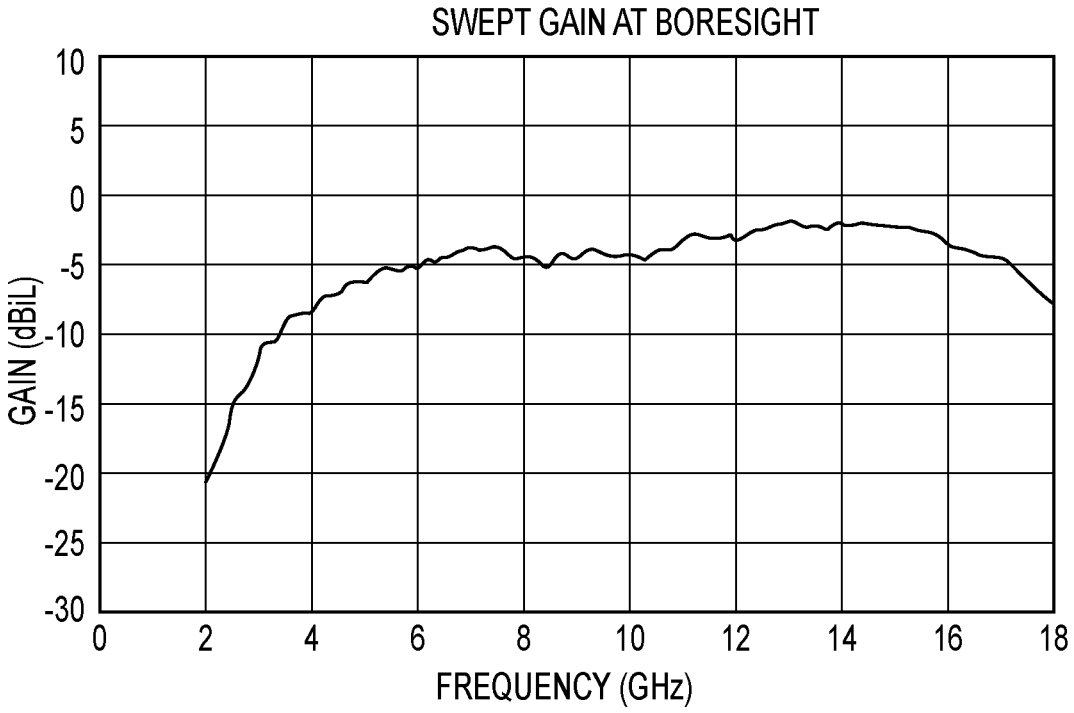
FIG. 7 depicts the broadband gain of an example antenna element in accordance with embodiments of the present invention.
Figure 8:
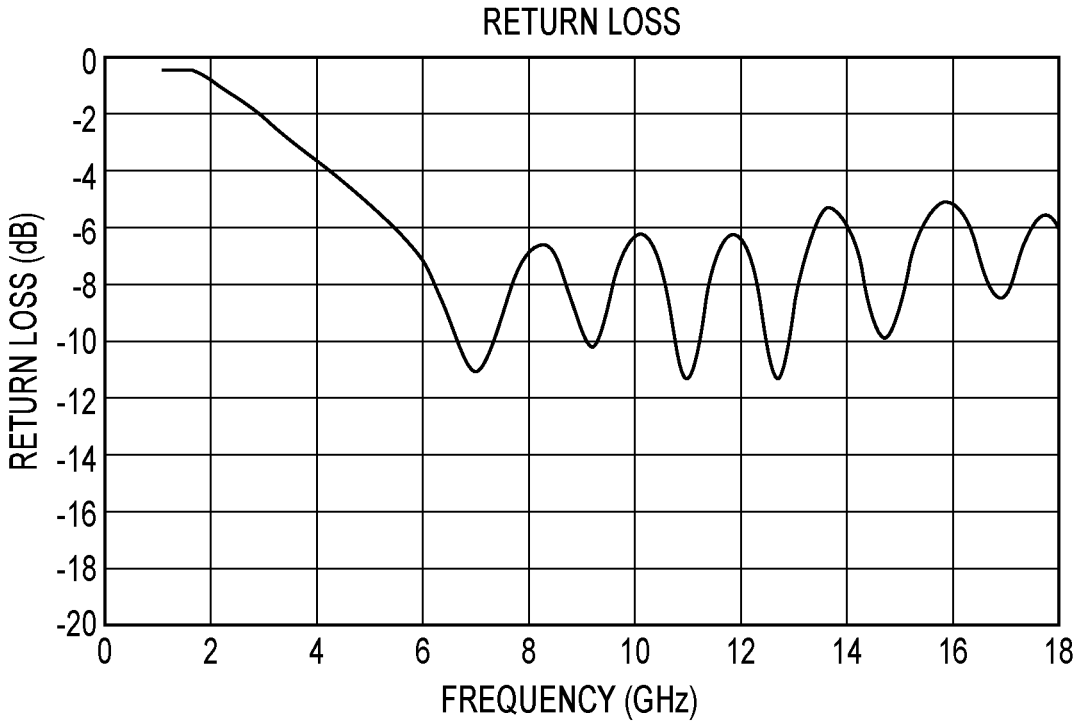
FIG. 8 depicts the return loss of an example antenna element accordance with embodiments of the present disclosure.
Figure 9:
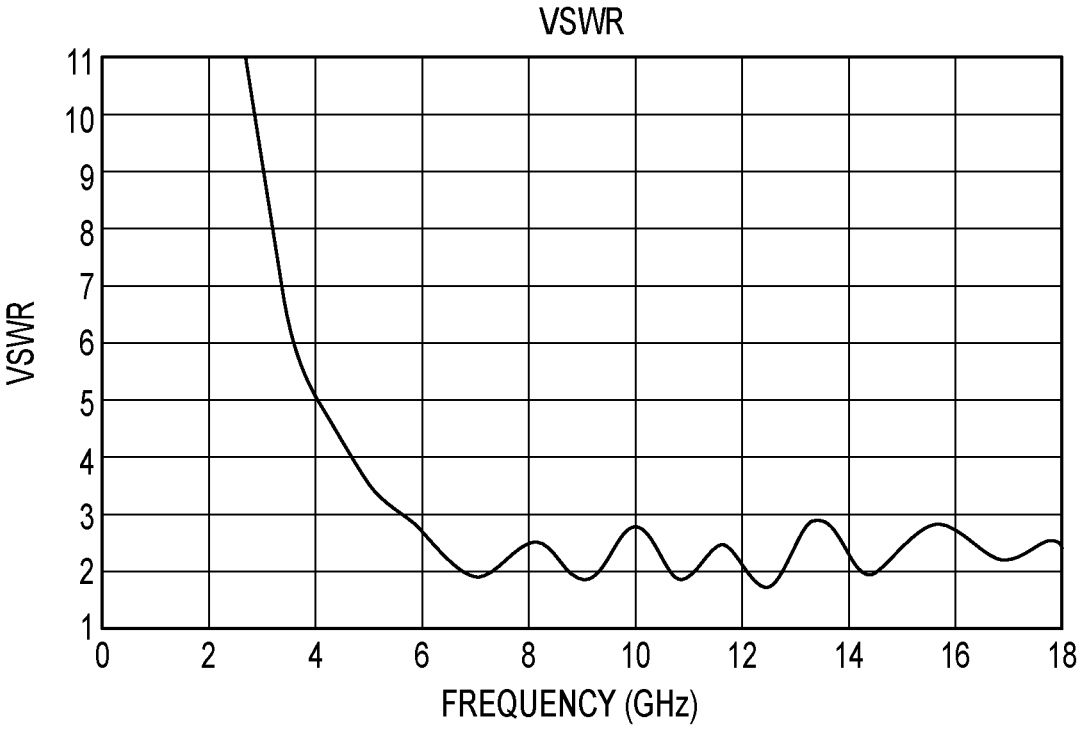
FIG. 9 depicts the voltage standing wave ratio of an example antenna element in accordance with embodiments of the present disclosure.
Figure 10:
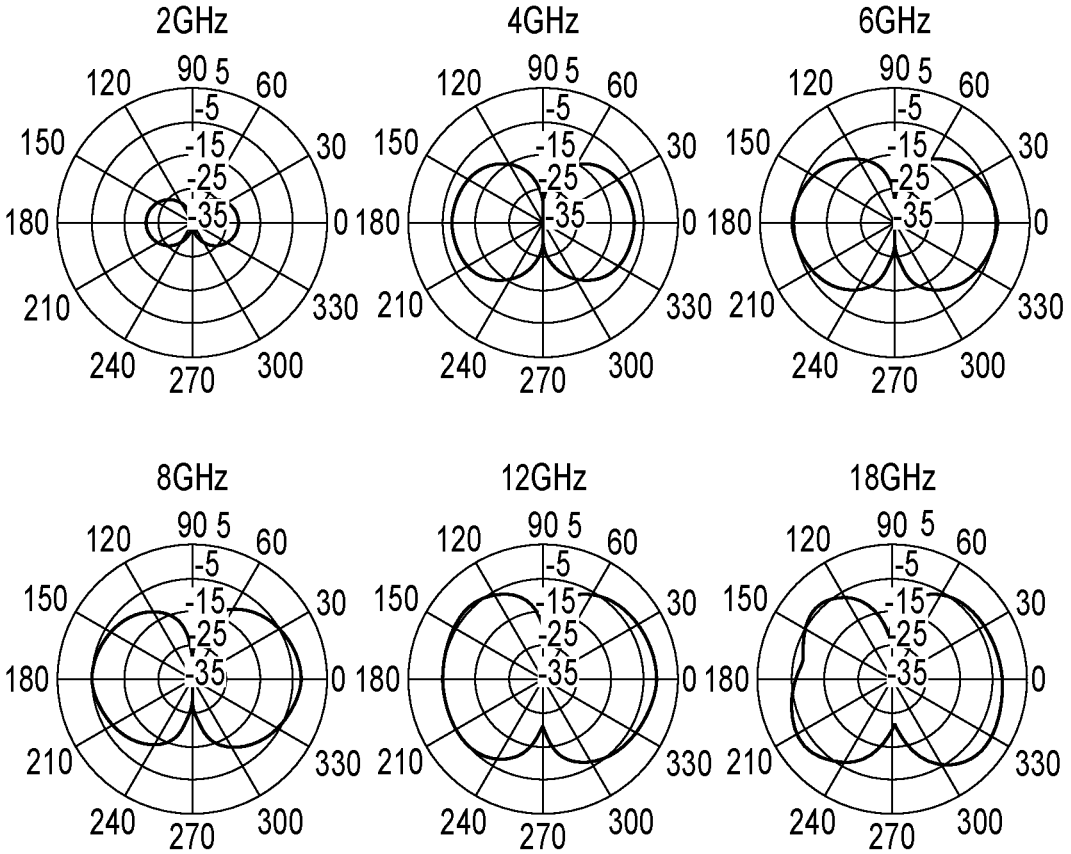
FIG. 10 depicts the radiation pattern of an example antenna element in accordance with embodiments of the present disclosure at different operating frequencies.

In the cavity backed slot antenna element 112 as disclosed herein, the FSS 216 allows for control of the illumination of the slot 208 aperture and prevents the antenna element 112 from over-moding at higher frequencies. The FSS 216 can also contribute to the match of the cavity backed slot antenna element 112, improving the broadband gain, the return loss, and the voltage standing wave ratio, and providing a stable radiation pattern. These attributes are depicted in FIGS. 7-10. In particular, FIG. 7 depicts the broadband gain of an example antenna element 112 in accordance with embodiments of the present invention, FIG. 8 depicts the return loss of an example antenna element 112 in accordance with embodiments of the present disclosure, FIG. 9 depicts the voltage standing wave ratio of an example antenna element 112 in accordance with embodiments of the present disclosure, and FIG. 10 depicts the radiation pattern of an example antenna element 112 in accordance with embodiments of the present disclosure at different operating frequencies. From these figures, it can be appreciated that a cavity backed slot antenna element 112 as described herein can provide excellent performance over a surprisingly wide bandwidth. Moreover, although these examples are within a range of 2-18 GHz (providing a bandwidth ratio of 1:9), a cavity backed slot antenna element 112 in accordance with embodiments of the present disclosure can be scaled to cover other frequency ranges.

Accordingly, embodiments of the present disclosure provide a cavity backed slot antenna element 112 that features an FSS 216 disposed within the slot 208. Moreover, embodiments of the disclosed cavity backed slot antenna element 112 provide the surprising result of a broadened effective bandwidth as compared to a conventional cavity type antenna. Moreover, such performance can be provided in a relatively compact format that can be mounted to a platform conformally.

A cavity backed slot antenna element 112 as described herein includes a cavity 256 that is electrically loaded by an FSS 216. The result is an increase in the effective electrical depth of the cavity 256, and a broadening of the operative bandwidth. In particular, the resulting bandwidth can extend from a frequency related to an expected operating frequency determined from the cavity configuration in the absence of the FSS, to a frequency related to an expected passband of the FSS, including any gaps between those frequencies. In addition, embodiments of the present disclosure can enable a reduction in the size of the antenna as compared to one employing conventional techniques. In particular, by increasing the effective electrical depth of the cavity 256, a cavity backed slot antenna element 112 as described herein can have dimensions of $0.169\lambda \times 0.051\lambda \times 0.034\lambda$, at the lowest operating frequency.

The present invention relates to a broadband cavity-backed slot antenna. The antenna includes a slot aperture with an integrated FSS (Frequency Selective Surface), a flared feed that can take on a multitude of shapes in different embodiments, and a cavity that can be filled with one or a combination of air, dielectric, absorber, and RAM (Radar Absorbing Material) depending upon the application requirements. Embodiments of antennas as disclosed herein may achieve a bandwidth of 9:1 in certain configurations, covering a range of 2-18 GHz for example, but may be scaled to operate in other frequency ranges as well.

The foregoing description has been presented for purposes of illustration and description. Further, the description is not intended to limit the disclosed systems and methods to the forms disclosed herein. Consequently, variations and modifications commensurate with the above teachings, within the skill or knowledge of the relevant art, are within the scope of the present disclosure. The embodiments described hereinabove are further intended to explain the best mode presently known of practicing the disclosed systems and methods, and to enable others skilled in the art to utilize the disclosed systems and methods in such or in other embodiments and with various modifications required by the particular application or use. It is intended that the appended claims be construed to include alternative embodiments to the extent permitted by the prior art.

What is claimed is:

1. An antenna, comprising:

a frequency selective surface;

a first ground plane, wherein a non-conductive slot is formed in the first ground plane, and wherein the frequency selective surface is located in an area of the non-conductive slot;

a first dielectric layer;

a feed element, wherein the first dielectric layer is between the feed element and the first ground plane; and a housing, wherein the housing is formed from a conductive material, wherein a cavity is formed in the housing, and wherein the cavity is adjacent the non-conductive slot.

2. The antenna of claim 1, wherein the frequency selective surface includes at least one of conductive, resistive, inductive, or capacitive components.

3. The antenna of claim 2, wherein the feed element includes a flared feed section and a stripline feed.

4. The antenna of claim 3, further comprising:

a second ground plane; and a second dielectric layer, wherein the second dielectric layer separates the second ground plane from the feed element.

5. The antenna of claim 4, further comprising:

a space filler in the cavity.

6. The antenna of claim 5, wherein the space filler includes at least one of air, a dielectric, an absorber, or a radar absorbing material.

7. The antenna of claim 4, wherein the second ground plane is between the housing and the second dielectric layer, and wherein the feed element is between the first dielectric layer and the second dielectric layer.

8. The antenna of claim 7, wherein a non-conductive slot is formed in the second ground plane in an area corresponding to the cavity.

9. The antenna of claim 1, wherein the frequency selective surface is located within the non-conductive slot.

10. The antenna of claim 1, wherein the feed element includes a flared feed section and a stripline feed, wherein the flared feed section includes side portions that extend away from one another with distance from an intersection of the flared feed section and the stripline feed, and wherein the side portions are located in an area that overlays the non-conductive slot.

11. The antenna of claim 10, wherein the flared feed section includes a curved portion connecting the ends of the side portions opposite the intersection of the side portions with the strip line feed, and wherein an area of the flared feed section between the ends of the side portions opposite the intersection of the side portions with the strip line feed and the curved portion overlays a portion of the first ground plane adjacent the non-conductive slot.

12. The antenna of claim 1, further comprising a magnetic material, wherein the magnetic material is at least one of adjacent to or included in the frequency selective surface.

13. The antenna of claim 1, wherein the antenna provides a 9:1 bandwidth ratio.

14. The antenna of claim 1, wherein the frequency selective surface includes a plurality of frequency selective surface elements, and wherein each of the frequency selective surface elements are connected to the first ground plane.

15. The antenna of claim 14, wherein some of the frequency selective surface elements extend from a first side of the non-conductive slot, and wherein others of the frequency selective surface elements extend from a second side of the non-conductive slot that is opposite the first side of the non-conductive slot.

16. The antenna of claim 14, wherein at least some of the frequency selective surface elements include electrically conductive areas connected to the first ground plane by a corresponding conductive component.

17. The antenna of claim 14, wherein at least some of the frequency selective surface elements include electrically conductive areas connected to the first ground plane by a corresponding resistive component.

18. The antenna of claim 14, wherein at least some of the frequency selective surface elements include electrically conductive areas connected to the first ground plane by a corresponding capacitive component.

19. The antenna of claim 18, wherein the frequency selective surface includes a plurality of frequency selective surface elements, and wherein at least other of the frequency selective surface elements include electrically conductive areas connected to the first ground plane by a corresponding resistive component.

20. The antenna of claim 19, wherein at least still other of the frequency selective surface elements include electrically conductive areas connected to the first ground plane by a corresponding conductive component.

* * * * *